US006553668B1

(12) United States Patent
Steinberg

(10) Patent No.: US 6,553,668 B1
(45) Date of Patent: Apr. 29, 2003

(54) ROTARY ELECTRIC SHAVER

(76) Inventor: Hy Steinberg, 9646 W. McNab Rd., Tamarac, FL (US) 33321

( * ) Notice: Subject to any disclaimer, the term of this patent is extended or adjusted under 35 U.S.C. 154(b) by 0 days.

(21) Appl. No.: 10/150,251

(22) Filed: May 16, 2002

(51) Int. Cl.[7] ..... B26B 19/14
(52) U.S. Cl. ..... 30/43.5; 30/43.6
(58) Field of Search ..... 30/43.4–43.92

(56) References Cited

U.S. PATENT DOCUMENTS 2,283,834 A * 5/1942 Van Dam et al. ..... 30/43.5
2,396,181 A * 3/1946 Kerwer ..... 30/43.92
3,406,448 A * 10/1968 Mac Carthy ..... 30/43.5
4,038,747 A * 8/1977 Upton ..... 30/34.2
5,983,501 A * 11/1999 Izumi ..... 30/43.5
6,212,776 B1 * 4/2001 Izumi et al.

FOREIGN PATENT DOCUMENTS

FR 1362062 * 4/1964 ..... 30/43.6

* cited by examiner

*Primary Examiner*—Douglas D. Watts

(57) ABSTRACT

A rotary electric shaver with a plurality of individually rotating cutting elements contained within a circular head frame that provides planetary motion to the cutting elements by rotating the head frame around the single central drive shaft of a single electric motor within the shaver body.

6 Claims, 3 Drawing Sheets

ROTARY ELECTRIC SHAVER

BACKGROUND OF THE INVENTION

1. Field of the Invention

The present invention pertains to rotary electric shavers having a plurality of circular cutting heads at the distal end of the shaver that are driven by a single electric motor within the shaver body.

2. Description of the Prior Art

Rotary electric shavers rely primarily upon the rotation of circular cutting elements within the shaver heads and hand movements of the entire shaver across the surface of facial skin in order to maximize the volume of hair shaved and how closely the hair is shaved. The prior improvements disclosed for rotary electric shavers with a plurality of cutting heads have concentrated on more effective designs and shapes for the cutting head elements, their flexibility and comformity to the skin surface and the configurations of the gear chains that drive these improvements. Izumi U.S. Pat. No. 5,983,501 discloses multiple planetary gear chain assemblies that are stacked within a cylindrical housing and around multiple drive axes for the purpose of driving both an inner set of high speed cutting heads and a surrounding outer set of low speed cutting heads all of which are supported within a stationary cutting head frame. Izumi U.S. Pat. No. 6,212,776 discloses an improved version of the rotary shaver that rotates the inner and outer cutting elements within each cutting head at different speeds by means of multiple drive shafts and gears that mesh with external gear teeth on the underside of each outer cutting element and wherein all cutting heads are contained and supported within a stationary head frame. Kakimoto U.S. Pat. No. 6,317,983 discloses another version of a rotary electric shaver having inner and outer cutting elements that rotate with respect to each other within cutting heads that are contained and supported within a stationary head frame. None of the past rotary shaver improvements have disclosed a concept and means for combining planetary and rotational movement of a plurality of rotary cutting heads driven by a central drive shaft of a single electric motor.

SUMMARY OF THE INVENTION

The present invention arose as a result of an absence in prior art of a simple solution to some of the problems associated with the use of the rotary electric shavers that are now widely marketed. The major problems are that rotary electric shavers require an excessive amount of time and an excessive amount of physical effort to achieve a close shave. The present invention eliminates these problems by substantially increasing the volume of hairs cut and the area of skin shaved by the cutting heads.

The factors determining the time and effort required for shaving with a rotary electric shavers are the circular movements of the cutting elements within the cutting heads and the movement of these cutting heads across the facial skin. In the present invention, a motorized sweeping motion of all the cutting heads across the facial skin is substituted for the user's slow, erratic hand movements of the entire shaver and the cutting heads. This is accomplished by rotating the cutting head frame within the body of the shaver. The planetary motion of the cutting heads eliminates the slow, circular movement of the shaver by hand as recommended by all manufacturers of rotary electric shavers.

For any interval of shaving time, the motorized planetary motion of all the cutting heads, in addition to the rotary motion within the cutting heads, produces a closely shaved area of skin and a volume of hair cuttings that can be two or three times the amount produced by the rotation of the cutting head elements without the additional superimposed motion of the rotating frame. This represents an improvement far in excess of what can be expected from any of the past improvements that have been made to the rotary cutting heads and their cutting elements.

An additional benefit of the rotating frame is that the planetary motion of the cutting heads enables the user to shave confined facial areas, such as above and below the lips with a single horizontal motion of the shaver instead of the repeated scrubbing with the uppermost cutting heads and hand maneuvering of the shaver body, as required with conventional rotary electric shavers.

The simple drive means for the rotatable frame and the use of existing drive gears as part of a speed reduction chain, as well as the use of the same electric motor as currently used, permits the rotatable frame to be incorporated within the structure of a triple-headed rotary electric shaver without great difficulty or prohibitive tooling costs. Furthermore, shaver improvements such as flexible or floating cutter heads and sideburn hair trimmers can easily be added to the rotary electric shaver described by the present invention.

DETAILED DESCRIPTION OF THE INVENTION

The underlying principles of the present invention and the importance of planetary movement of the cutting heads in a rotary shaver can be best explained by an examination of the shaving patterns of cutting heads as illustrated in FIGS. 1,2,3,4, and 5.

Figure 1:
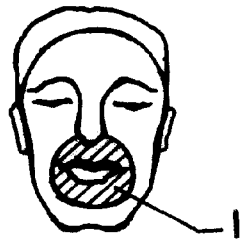
FIG. 1 is a diagram of the areas of facial hair that are difficult to shave with conventional rotary electric shavers.

In FIG. 1, the shaded area 1 represents the facial areas of skin that are the most difficult to shave with conventional rotary shavers, including shavers with flexible and floating cutting heads. The narrow, sensitive area around the mouth and the curved chin area 1 cannot be adequately shaved without some scrubbing action along with twisting and manipulation of the entire shaver body so that at least one or two of the cutting heads make contact with the skin. With the present invention, all three shaving heads make contact on these narrow facial areas with a rapid, sweeping motion that eliminates the problems encountered with a conventional rotary electric shaver.

Figure 2:
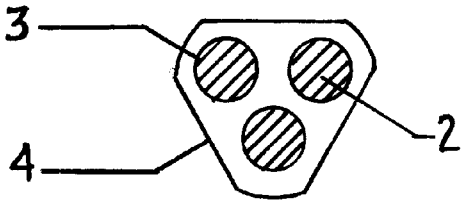
FIG. 2 illustrates the area and volume of hair shaved by a conventional rotary electric shaver with a fixed cutting head frame when held in a stationary position against the facial skin.

In FIG. 2, the shaded area 2 represents the skin area exposed to each of the three rotating cutting elements 3 and the theoretical maximum volume of hair that can be cut by the conventional fixed-head shaver 4 pressed against the skin without any movement of the shaver body during a one-second time interval. The area exposed to cutting action is the area of the circular footprint 2 for a single ¾ inch diameter cutting element 3 multiplied by three and totals approximately 1.5 square inches. However, the volume of hair actually cut by the conventional rotary shaver, without movement of the shaver head, is less than 15 percent of the hair located within the 1.5 square inches of skin no matter how long the shaver is held in place against the skin.

The volume of hair shaved by each rotary cutting head depends almost entirely upon the distance the cutting head itself moves across the facial surface and the number of times it moves across the same area. Unlike the edge of a straight razor blade, the face of the rotary cutting head cannot reach and cut the hair at its base in a single pass. It cuts the hair ends incrementally with more than one pass of the cutter head over the facial area, which contributes to the powdery texture of the hair residue under the rotary cutting heads. As a result, the entire body of conventional rotary shavers must be moved across the skin repeatedly by hand to provide a close shave.

Figure 3:
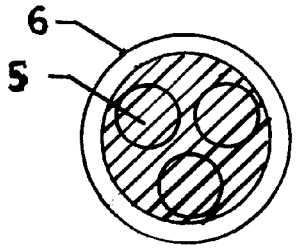
FIG. 3 illustrates the area and volume of hair shaved by a rotary electric shaver with a rotating cutting head frame when held in a stationary position against the facial skin.

In FIG. 3, the shaded area represents the area of skin exposed to the same size cutting heads 5 as in FIG. 2, except that the heads are contained within a circular head frame 6 rotating at 240 rpm (4 revolutions per second) during a time interval of one second without any movement of the shaver body.

The area exposed to the moving action of the cutting heads equals the area of its 1.8 inch diameter circular footprint covered by the cutter heads 5 and totals approximately 2.5 square inches. As a result of the motorized rotation of the head frame 6 over 90 percent of the hair within the 2.5 square inch area is shaved closely within one second of stationary exposure to the skin surface.

Figure 4:
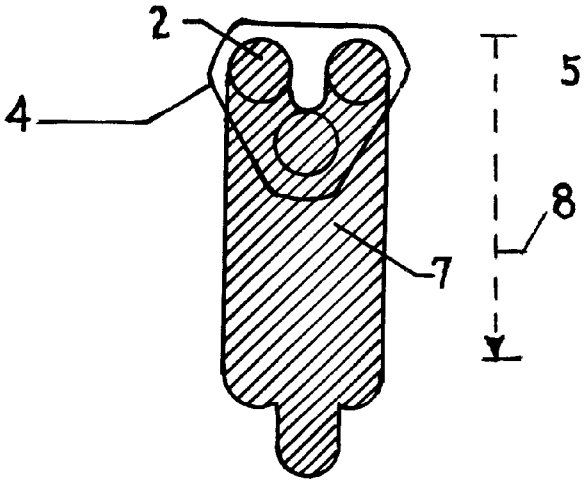
FIG. 4 illustrates the area and total distance traversed by the cutting heads of a rotary electric shaver with a conventional fixed cutting head frame during a one-second, three-inch movement of the shaver body.

In FIG. 4, the shaded area 7 represents the total area of skin that is traversed during a one-second, 3-inch long hand-movement 8 of the conventional rotary shaver 4 and the cutting elements 3 of FIG. 2. With an approximate path width of 1.7 inches, the total area 7 traversed is 5 square inches.

Figure 5:
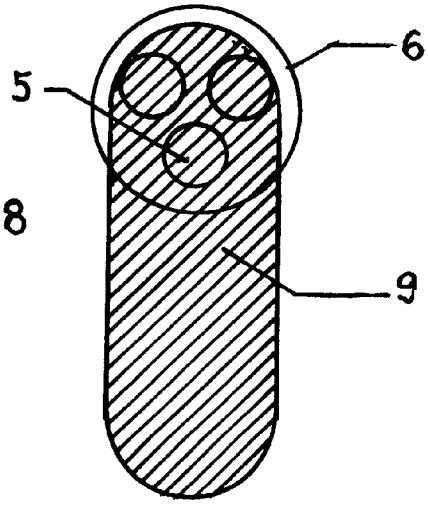
FIG. 5 illustrates the area and total distance traversed by the cutting heads of a rotary electric shaver with a rotating cutting head frame during a one-second, three-inch movement of the shaver body.

In FIG. 5, the shaded area 9 indicates the area of facial skin traversed during the same one-second, 3-inch long hand-movement 8 of the rotary shaver of FIG. 3 with a head frame 6 rotating at 240 rpm (4 revolutions per second). Using the same cutter head diameters and approximate path width as in FIG. 4, the total footprint 9 of 5 square inches is traversed four times by the cutter heads in the rotating head frame 6 for a total coverage of 20 square inches. A shaving coverage increase, from 5 square inches (FIG. 4) to 20 square inches, during a one-second time span, demonstrates the inherent capacity of the rotating frame to provide a much faster and closer shave.

The substitution of motorized movement of the head frame for repetitious hand movements of the shaver body represents a substantial improvement in rotary shaver performance and the option of producing rotary shavers with different head frame rotation speeds offers wide marketing opportunities.

The practical range of speed for the rotating head frame is between 60 rpm and 480 rpm. At speeds less than 60 rpm, the benefits and advantages of the rotating frame are minimized because the motorized movement of the cutting heads across the facial area approaches the same speed that can be reached with conventional rotary shavers and rapid hand movements of the entire shaver body. The advantages of frame rotation increase with corresponding increases in the speed of frame rotation. If the speed of the rotating frame is set at a higher speed, such as 300 or 360 rpm and combined with minimal hand movement of the shaver, the shaving speed and other advantages of the rotating frame become more pronounced. However at speeds above 480 rpm the increasing rate of performance is sharply reduced unless the speed of the cutting elements around their own axis (generally 3,000 rpm.) is raised to a higher level. Furthermore, at speeds higher than 480 rpm, sensitive facial skin areas may exhibit some discomfort due to friction, particularly if the shaver head is pressed firmly against the skin and held in place without any movement for more than a few seconds. The higher speeds may also require the delivery of more torque power from the electric drive motor as well as the use of costlier friction reducing designs and materials for the contact surfaces between the rotatable head frame and the shaver body.

The optimum range of head frame rotation speed, considering shaving comfort and speed as well as manufacturing cost, lies between 120 rpm and 360 rpm. (2–6 revolutions per second). The particular speed selected for the rotating frame within this range depends largely upon the specific design of the rotary cutting heads, the rotation speed of the cutting elements and the design details and materials selected for the sliding contact surfaces of the rotatable frame structure. Any fixed speed for the rotating frame within the optimum range can be achieved with the use of one or two appropriately sized speed-reduction cluster gears linking the sun gear on the central drive shaft to the internal gear ring on the shaver body (as in FIGS. 6 and 7).

Figure 6:
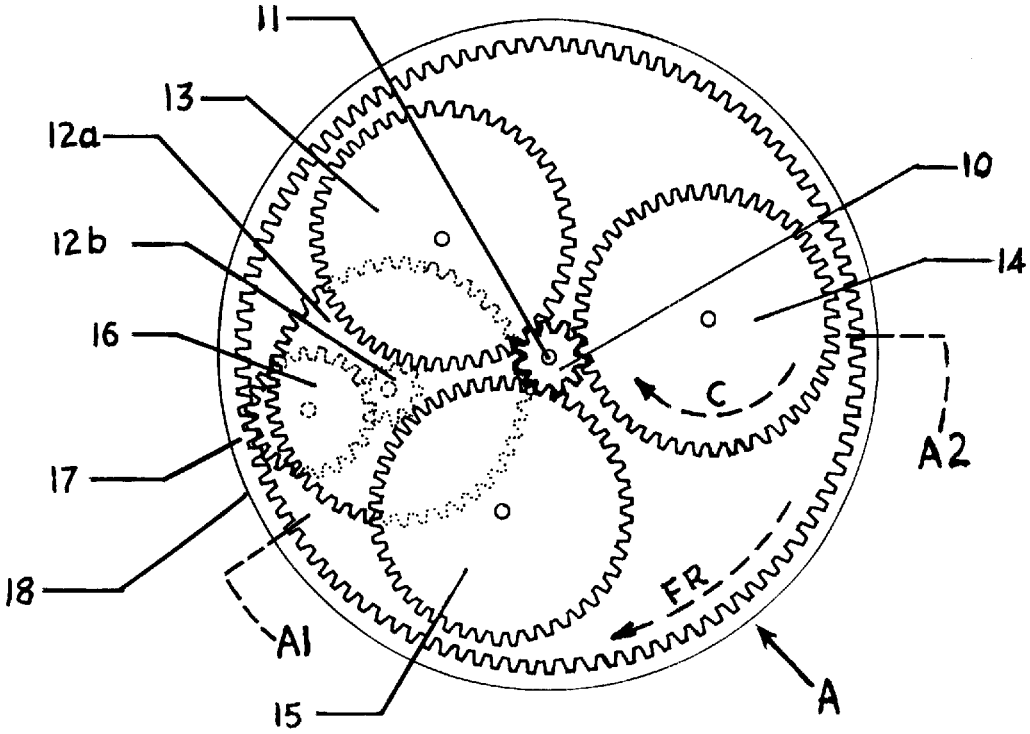
FIG. 6 is a diagrammatic plan view of a preferred embodiment of the gear arrangement that can be used to drive the rotation of the cutting head frame described by the present invention.

FIG. 6 shows the gear chain arrangements for a preferred embodiment of the invention wherein one or more speed reduction gear chains can be used to drive the rotatable platform. The sun gear 10 on the central drive shaft 11 is meshed to the clustered speed reduction gears 12*a* and 12*b* located below the spur gears 13 and 15 that drive the cutting heads. The clustered speed reduction gear 12*b* is meshed to the spur gear 16 that protrudes from the rotating frame perimeter to mesh with the internal gear ring 17 affixed to the inner surface 18 of the shaver body, thereby rotating the frame. If necessary, this gear chain can be duplicated on either side of the spur gear 14. The head frame is effective when rotating in either the same or opposite direction of the cutting head rotation. In this gear arrangement the head frame FR and the cutter heads C rotate in the same direction.

Figure 7:
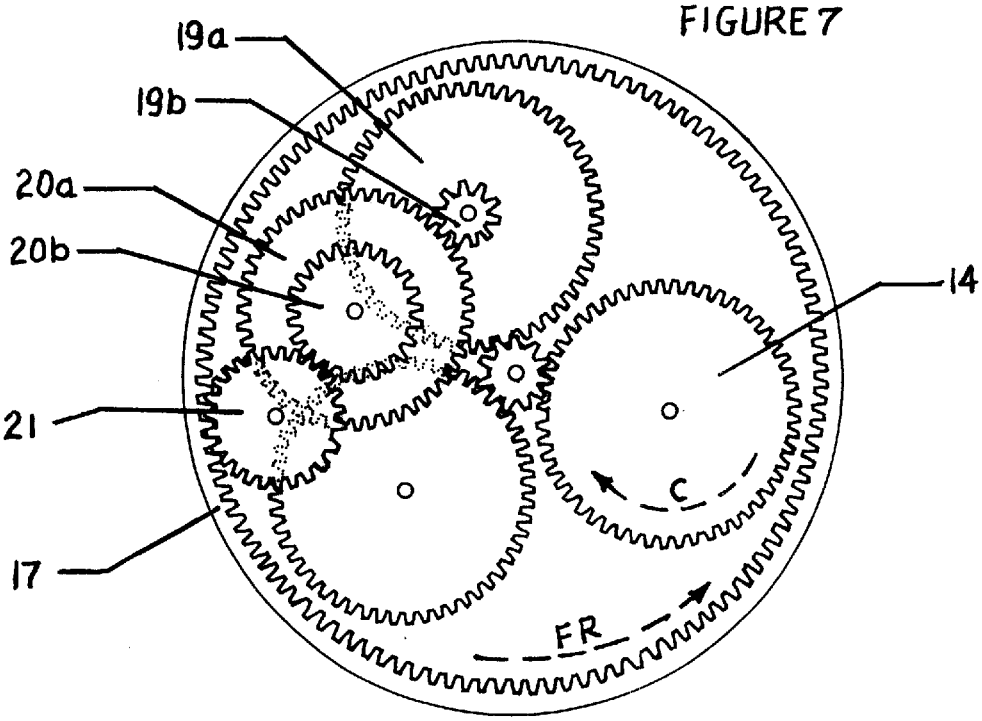
FIG. 7 is a diagrammatic plan view of a second embodiment of the gear arrangements that can be used to drive the rotatation of the cutting head frame described by the present invention.

FIG. 7. illustrates an embodiment of the invention wherein an existing spur gear 19*a* that drives one of the cutter heads is converted to a speed reduction cluster gear by the addition of a smaller spur gear 19*b* to the same axis. The clustered spur gear 19*b* meshes with the speed reduction cluster gear 20*a* and the clustered smaller gear 20*b* meshes with the spur gear 21 that protrudes from the head frame perimeter to mesh with the fixed internal gear ring 17 and rotate the head frame. This gear chain can also be duplicated on either side of the spur gear 14. In this gear arrangement the frame rotation FR is in the opposite direction of the cutting head rotation C.

At the higher speeds of frame rotation the use of more than one chain of gears to drive the frame rotation can serve to increase the torque power delivered to the internal gear ring and to improve the stability of the rotating head frame.

The need for any additional drive chains can be eliminated by means of commonly used design details and low coefficient of friction materials, such as fluorocarbon inserts, washers or surface treatments, and by minimizing the contact points of the sliding surface areas. Some of the simple configurations that can be used for the mating surfaces are shown in FIG. 8.

Figure 8:
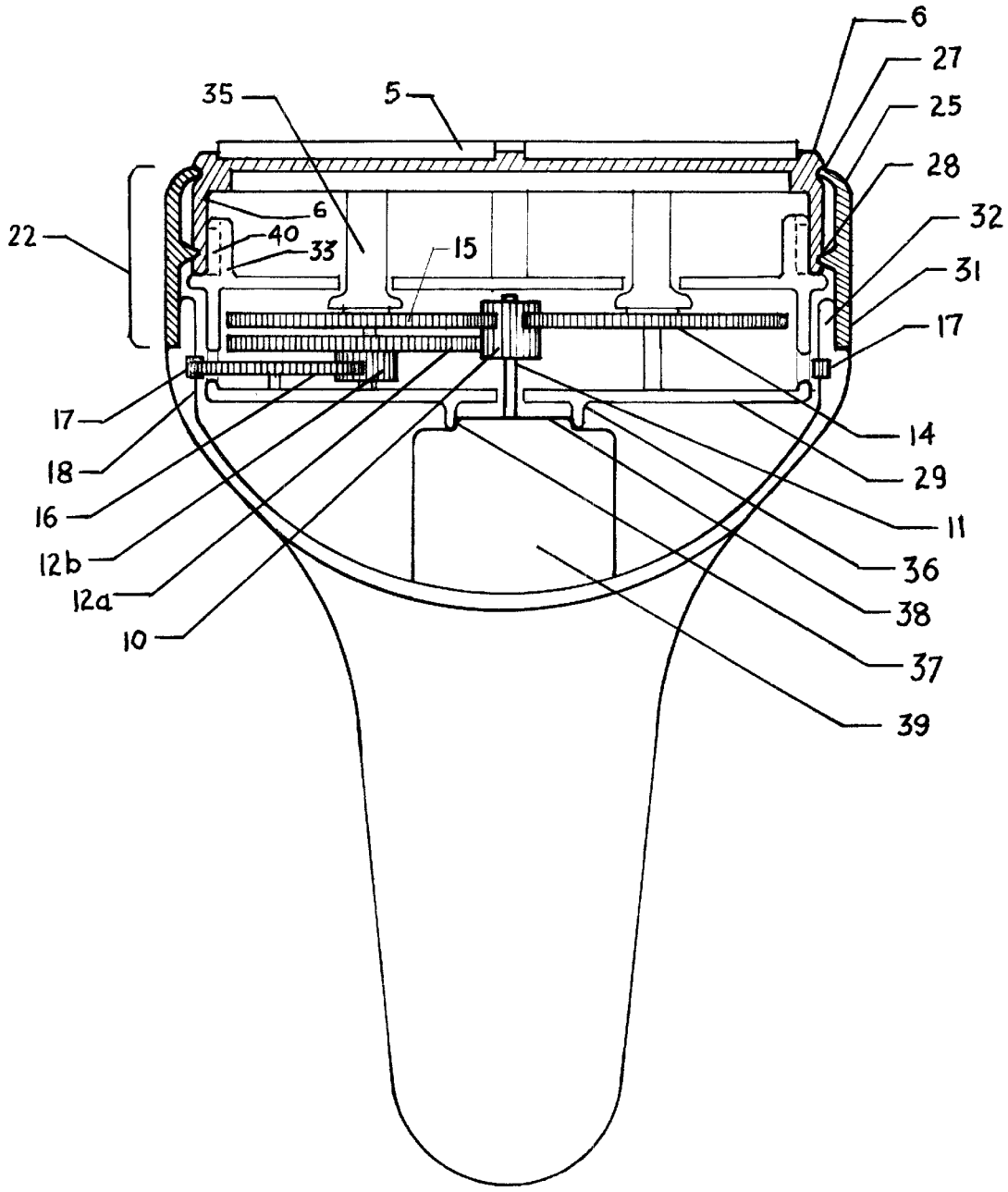
FIG. 8 is an elevational view of the top of the rotary electric shaver with the rear portion of the outer body and collar removed (B1 to B2 in FIG. 6 ) to illustrate a side view of the gear arrangement of FIG. 6 and a section of the detachable part of the head frame within the detachable collar.

FIG. 8 is an elevational rear view of the top portion of the shaver with part of the outer shaver body between A1 and A2 (see FIG. 6) removed to expose the interior view A (FIG. 6) and show the relationship between the rotatable head frame structure, the detacheable collar, the gear chain of FIG. 6 and the single electric motor. The contact between the rotating frame and the inner shaver body surface occurs at the detachable cylindrical collar 22, at the top surface of the drive motor 37 and at the inner gear ring 17. The detacheable collar 22 and its upper lip 25 make contact with the outside shoulder of the rotatable frame 6 within a groove 27. A fluorocarbon plastic ring can be inserted into the groove, if required, to reduce friction at this point. The lower lip 28 of the collar also makes sliding contact with the rotatable frame and serves to lift the included upper portion 6 of the rotatable frame with the cutting heads 5 when it is detached from the shaver body for cleaning. The lowest cylindrical portion of the collar 31 is seated adjacent to the wall 32 of the shaver body and is vertically and detachably locked into place by embedded, spring-loaded connectors that are commonly used such purpose in rotary electric shavers. Matching male-to-female vertical slots 40 between the adjacent vertical walls 33 and 6 of the rotating frame serve to align the collar 22 radially with the protruding cutting head pinions when replacing the collar after its removal for cleaning. The fixed, circular gear ring 17 that drives the rotatable frame is mounted on the inner circumference of the shaver body 18 and meshes with the outermost spur gear 16 of the drive chain of FIG. 6. The outermost gear 16 also meshes with the gear 12*b* clustered with gear 12*a* which meshes with the sun gear 10 that drives the planetary gears 13, 14 and 15 (FIG. 4) and their respective spindles 35 and cutting heads 5. For inertial stability, the bottom surface of the rotating frame has cylindrical projections 36 with sliding contact in a groove 37 or against a raised platform 38 around the central drive axis 11 of the electric motor 39.

The embodiments of the invention described and illustrated herein are not meant to exclude other configurations or the substitution, addition, or modification of any of the shaver elements or materials used, in order to practice the teachings that are within the scope of the claims of this invention.

I claim:

1. A rotary electric shaver comprising a circular frame within an outer body wherein said frame is rotatable about a central drive shaft contained in said body, and wherein a plurality of circular cutting heads with external foils and internally spinning cutter blades are mounted on said frame to rotate in unison with said frame in planetary motion around said central drive shaft, said drive shaft being driven by an electric motor within said body.

2. A rotary electric shaver according to claim 1, wherein said frame has a speed of rotation between 60 rpm and 480 rpm.

3. A rotary electric shaver according to claim 1, wherein the circular blades cutting of said cutting heads are driven by spur gears meshed to a common sun gear on said central drive shaft; and at least one chain of gears is meshed to said sun gear wherein the outermost gear of said chain protrudes outside the perimeter of said rotatable frame and meshes with an internal gear ring on the inner circumference of said shaver body.

4. A rotary electric shaver according to claim 3, wherein at least one of the spur gears driving said cutting blades is joined to a smaller spur gear on the same axis to serve as a clustered speed-reduction gear within the chain of gears driving said rotatable frame.

5. A rotary electric shaver according to claim 3, having a non-rotatable, and, detachable, circular outer collar surrounding said rotatable frame with an internal upper lip for sliding contact against the outer of said rotatable frame and an internal lower lip for sliding contact against said rotatable frame below said cutting heads.

6. A rotary electric shaver according to claim 3, wherein the bottom of said rotatable frame is in sliding contact around a central circular platform within the top of said electric motor.

* * * * *

UNITED STATES PATENT AND TRADEMARK OFFICE

CERTIFICATE OF CORRECTION

PATENT NO. : 6,553,668 B1
DATED : April 29, 2003
INVENTOR(S) : Hy Steinberg

It is certified that error appears in the above-identified patent and that said Letters Patent is hereby corrected as shown below:

Column 1,
Line 19, "comformity" should be -- conformity --

Column 2,
Line 56, should read -- outer body and collar removed (A1 to A2 in FIG. 6) --

Column 5,
Line 48, "the sun gear 10 that drives the planetary gears 13, 14 and 15 (FIG. 4)……." should be -- (FIG. 6)…… --

Signed and Sealed this

Nineteenth Day of August, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,553,668 B1
APPLICATION NO. : 10/150251
DATED : April 29, 2003
INVENTOR(S) : Hy Steinberg It is certified that error appears in the above-identified patent and that said Letters Patent is hereby corrected as shown below:

Column 6,
Line 25, "the circular blades cutting……" should read "the circular cutting blades……"

Signed and Sealed this

Twenty-second Day of August, 2006

JON W. DUDAS
*Director of the United States Patent and Trademark Office*